US011191295B2

(12) United States Patent
Mironov

(10) Patent No.: US 11,191,295 B2
(45) **Date of Patent: *Dec. 7, 2021**

(54) INDUCTIVELY HEATABLE TOBACCO PRODUCT

(71) Applicant: PHILIP MORRIS PRODUCTS S.A., Neuchatel (CH)

(72) Inventor: Oleg Mironov, Neuchatel (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 63 days.

This patent is subject to a terminal disclaimer.

(21) Appl. No.: 16/188,590

(22) Filed: Nov. 13, 2018

(65) Prior Publication Data

US 2019/0075851 A1 Mar. 14, 2019

Related U.S. Application Data

(63) Continuation of application No. 14/899,223, filed as application No. PCT/EP2015/061197 on May 21, 2015, now Pat. No. 10,327,473.

(30) Foreign Application Priority Data

May 21, 2014 (EP) ..... 14169187

(51) Int. Cl.

| | |
|---|---|
| ***A24B 3/14*** | (2006.01) |
| ***A24B 13/00*** | (2006.01) |
| ***A24B 15/14*** | (2006.01) |
| ***A24D 1/20*** | (2020.01) |
| ***A24D 3/17*** | (2020.01) |

(52) U.S. Cl.
CPC ..... *A24B 3/14* (2013.01); *A24B 13/00* (2013.01); *A24B 15/14* (2013.01); *A24D 1/20* (2020.01); *A24D 3/17* (2020.01)

(58) Field of Classification Search
None
See application file for complete search history.

(56) References Cited

U.S. PATENT DOCUMENTS

| | | | |
|---|---|---|---|
| 3,549,847 | A | 12/1970 | Clark |
| 5,144,962 | A | 9/1992 | Counts |
| 5,269,327 | A | 12/1993 | Counts |

(Continued)

FOREIGN PATENT DOCUMENTS

| | | | |
|---|---|---|---|
| CN | 1126426 | A | 7/1996 |
| CN | 101778577 | | 7/2010 |

(Continued)

OTHER PUBLICATIONS

PCT Search Report and Written Opinion for PCT/EP2015/061197 dated Sep. 8, 2015 (9 pages).

(Continued)

*Primary Examiner* — Phu H Nguyen
(74) *Attorney, Agent, or Firm* — Oblon, McClelland, Maier & Neustadt, L.L.P.

(57) ABSTRACT

The inductively heatable tobacco product for aerosol-generation comprises an aerosol-forming substrate containing a susceptor in the form of a plurality of particles. The aerosol-forming substrate is a crimped tobacco sheet comprising tobacco material, fibers, binder, aerosol-former and the susceptor in the form of the plurality of particles.

13 Claims, 2 Drawing Sheets

(56) References Cited

U.S. PATENT DOCUMENTS

| | | | | |
|---|---|---|---|---|
| 5,613,505 | A * | 3/1997 | Campbell | A24F 47/008 128/202.21 |
| 6,681,998 | B2 | 1/2004 | Sharpe | |
| 8,353,302 | B2 | 1/2013 | Olegario | |
| 2007/0215168 | A1 | 9/2007 | Banerjee et al. | |
| 2008/0006796 | A1* | 1/2008 | Khatua | C04B 35/4682 252/500 |
| 2014/0096781 | A1 | 4/2014 | Sears | |
| 2015/0107610 | A1* | 4/2015 | Metrangolo | A24B 3/14 131/329 |

FOREIGN PATENT DOCUMENTS

| | | | | |
|---|---|---|---|---|
| EP | 2444112 | 4/2012 | | |
| JP | 2-126588 | 5/1990 | | |
| JP | 08-511175 | 11/1996 | | |
| JP | 2002108124 | 4/2002 | | |
| JP | 2004-89704 | 3/2004 | | |
| JP | 2005-516357 | 6/2005 | | |
| JP | 2008-82700 | 4/2008 | | |
| JP | 2009-529872 | 8/2009 | | |
| KR | 10-2010-0015452 | 2/2010 | | |
| WO | WO 94/06314 | 3/1994 | | |
| WO | WO 95/27411 | 10/1995 | | |
| WO | WO 03/063548 | 7/2003 | | |
| WO | WO 2008/110931 | 9/2008 | | |
| WO | WO 2013/098396 | 7/2013 | | |
| WO | WO 2013/178767 | 12/2013 | | |
| WO | WO 2013/178769 | 12/2013 | | |
| WO | WO-2013178767 | A1 * | 12/2013 | A24B 3/14 |
| WO | WO 2014/016961 | 1/2014 | | |
| WO | WO 2014/048745 | 4/2014 | | |

OTHER PUBLICATIONS

Office Action issued in Japan for Application No. 2017-120356 dated Mar. 9, 2020 (6 pages). English translation included.

* cited by examiner

INDUCTIVELY HEATABLE TOBACCO PRODUCT

This application is a continuation application of U.S. application Ser. No. 14/899,223, filed Dec. 17, 2015 and which is a U.S. National Stage Application of International Application No. PCT/EP2015/061197, filed May 21, 2015, which was published in English on Nov. 26, 2015 as International Patent Publication WO 2015/177252. International Application No. PCT/EP2015/061197 claims priority to European Application No. 14169187.3 filed May 21, 2014. A certified copy of European Application No. 14169187.3 filed May 21, 2014, was provided in, and is available in, U.S. patent application Ser. No. 14/899,223 for which certified copy is available in PAIR.

The invention relates to an inductively heatable tobacco product for aerosol generation. The tobacco product is especially suitable for use in an inductive heating device for aerosol generation.

In electrically heatable smoking devices for example a tobacco plug made of a tobacco sheet containing tobacco particles and glycerin as aerosol-former is heated by a heatable blade. In use, the tobacco plug is pushed onto the blade such that the plug material is in close thermal contact with the heated blade. In aerosol-generating devices, the tobacco plug is heated to evaporate the volatile compounds in the plug material, preferably without burning the tobacco as in conventional cigarettes. However, in order to heat remote peripheral regions of a plug for aerosol generation, the material proximate to the heating blade has to be excessively heated such that burning of tobacco in the vicinity of the blade may not entirely be prevented.

It has been proposed to use inductive heating for an aerosol-forming substrate. It has also been proposed to disperse discrete susceptor material within tobacco material. However, no solution has been proposed for an optimal heating of a tobacco plug made of a crimped tobacco sheet.

Therefore, there is need for an inductively heatable tobacco product optimized for aerosol generation. Especially, there is need for such a tobacco product that allows for an optimized aerosol generation of a tobacco plug made of an aerosol former containing crimped tobacco sheet.

According to an aspect according to the invention, there is provided an inductively heatable tobacco product for aerosol generation. The tobacco product comprises an aerosol-forming substrate containing a susceptor in the form of a plurality of particles. The aerosol-forming substrate is a crimped tobacco sheet comprising tobacco material, fibers, binder, aerosol former and the susceptor in the form of the plurality of particles. The susceptor within the tobacco product has the ability to convert energy transferred as magnetic waves into heat, referred to herein as a heat loss. The higher the heat loss, the more energy transferred as magnetic waves to the susceptor is converted by the susceptor into heat. Preferably, a heat loss of 0.008 Joule per kilogram or more, of more than 0.05 Joule per kilogram, preferably a heat loss of more than 0.1 Joule per kilogram is possible during a single sinusoidal cycle applied to a circuit provided to excite the susceptor. By changing a frequency of the circuit a heat loss per kilogram per second may be varied. Typically a high frequency current is provided by a power source and flows through an inductor for exciting the susceptor. A frequency in an inductor or of a circuit, respectively, may be in a range between 1 MHz and 30 MHz, preferably in a range between 1 MHz and 10 MHz or 1 MHz and 15 MHz, even more preferably in a range between 5 MHz and 7 MHz. The term 'in a range between' is herein and in the following understood as explicitly also disclosing the respective boundary values.

In preferred embodiments, the tobacco product according to the invention has a heat loss of at least 0.008 Joule per kilogram. The heat loss may be achieved during a single cycle applied to a circuit, which circuit is provided for exciting the susceptor and which circuit preferably has a frequency in a range between 1 MHz and 10 MHz.

Alternatively, if a minimum wattage, or Joule per second, is known based on the substrate composition and size, then the susceptor may be provided within the substrate as a weight percentage sufficient to enable the minimal desired wattage.

As discussed above, heat loss is the capacity of the susceptor to transfer heat to the surrounding material. Heat is generated in the susceptor in the form of the plurality of the particles. The susceptor predominantly conductively heats the intimately contacting or proximal tobacco material and aerosol former to evolve the desired flavours. Thus, heat loss is specified by the material and by the contact of the susceptor to its surrounding. In the tobacco product according to the invention, the susceptor particles are preferably homogeneously distributed in the aerosol-forming substrate. By this, a uniform heat loss in the aerosol-forming substrate may be achieved thus generating a uniform heat distribution in the aerosol-forming substrate and in the tobacco product leading to a uniform temperature distribution in the tobacco product.

Uniform or homogeneous temperature distribution of the tobacco product is herein understood as a tobacco product having a substantially similar temperature distribution over a cross section of the tobacco product. Preferably, the tobacco product may be heated such that temperatures in different regions of the tobacco product, such as for example central regions and peripheral regions of the tobacco product, differ by less than 50 percent, preferably by less than 30 percent.

It has been found that a specific minimal heat loss of 0.05 Joule per kilogram in the tobacco product allows to heat the tobacco product to a substantially uniform temperature, which temperature provides good aerosol generation.

Preferably, average temperatures of the tobacco product are about 200 degree Celsius to about 240 degrees Celsius. This has been found to be a temperature range where desired amounts of volatile compounds are produced, especially in tobacco sheet made of homogenized tobacco material with glycerin as aerosol former, especially in cast leaf as will be described in more detail below. At these temperatures no substantial overheating of individual regions of the tobacco product is achieved, although the susceptor particles may reach temperatures of up to about 400 to 450 degree Celsius.

The susceptor particles are embedded in the tobacco sheet and thus in the aerosol-forming substrate. The particles are immobilized and remain at an initial position. The particles may be embedded on or within the tobacco sheet. Preferably, the particles are homogeneously distributed in the aerosol-forming substrate. Through embedding of the susceptor particles in the substrate, a homogeneous distribution remains homogeneous also upon formation of the tobacco product by crimping the tobacco sheet and forming the tobacco product. For example, a rod may be formed of the crimped tobacco sheet, which rod may be cut into a required rod length of the tobacco product.

Preferably, the tobacco sheet is a cast leaf. Cast leaf is a form of reconstituted tobacco that is formed from a slurry including tobacco particles, fiber particles, aerosol former, binder and for example also flavours.

Tobacco particles may be of the form of a tobacco dust having particles in the order of 30 micrometers to 250 micrometers, preferably in the order of 30 micrometers to 80 micrometers or 100 micrometers to 250 micrometers, depending on the desired sheet thickness and casting gap, where the casting gap typically defines the thickness of the sheet.

Fiber particles may include tobacco stem materials, stalks or other tobacco plant material, and other cellulose-based fibers such as wood fibers having a low lignin content. Fiber particles may be selected based on the desire to produce a sufficient tensile strength for the cast leaf versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry forming the cast leaf may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. An aerosol former may be chosen based on its ability, for example, to remain stable at or around room temperature but able to volatize at a higher temperature, for example, between 40 degree Celsius and 450 degree Celsius. The aerosol former may also have humectant type properties that help maintain a desirable level of moisture in an aerosol-forming substrate when the substrate is composed of a tobacco-based product including tobacco particles. In particular, some aerosol formers are hygroscopic material that functions as a humectant, that is, a material that helps keep a substrate containing the humectant moist.

One or more aerosol former may be combined to take advantage of one or more properties of the combined aerosol formers. For example, triacetin may be combined with glycerin and water to take advantage of the triacetin's ability to convey active components and the humectant properties of the Glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

A typical process to produce cast leaf includes the step of preparing the tobacco. For this, tobacco is shredded. The shredded tobacco is then blended with other kinds of tobacco and grinded. Typically, other kinds of tobacco are other types of tobacco such as Virginia or Burley, or may for example also be differently treated tobacco. The blending and grinding steps may be switched. The fibers are prepared separately and preferably such as to be used for the slurry in the form of a solution. The solution and the prepared tobacco are then mixed, preferably together with the susceptor particles. To form the cast leaf, the slurry is transferred to a sheet forming apparatus. This may for example be a surface, for example of a continuous belt where the slurry may continuously be spread onto. The slurry is distributed on the surface to form a sheet. The sheet is then dried, preferably by heat and cooled after drying. The susceptor particles may also be applied to the slurry after being brought into the form of a sheet but before the sheet is dried. By this, the susceptor particles are not homogeneously distributed inside the sheet material but may still be homogenously distributed in the tobacco product formed by crimping the tobacco sheet. Before the cast leaf is wound onto a bobbin for further use, the edges of the cast leaf are trimmed and the sheet may be slitted. However, slitting may also be performed after the sheet has been wound onto a bobbin. The bobbin may then be transferred to a sheet processing installation, such as for example a crimping and rod forming unit or may be put to a bobbin storage for future use.

The crimped tobacco sheet, for example a cast leaf, may have a thickness in a range of between about 0.5 millimeter and about 2 millimeter, preferably between about 0.8 millimeter and about 1.5 millimeter, for example 1 millimeter. Deviations in thickness of up to about 30 percent may occur due to manufacturing tolerances A susceptor is a conductor that is capable of being inductively heated. A susceptor is capable of absorbing electromagnetic energy and converting it to heat. In the tobacco product according to the invention, changing electromagnetic fields generated by one or several induction coils of an inductive heating device heats the susceptor, which then transfers the heat to the aerosol-forming substrate of the tobacco product, mainly by conduction of heat. For this, the susceptor is in thermal proximity to the tobacco material and aerosol former of the aerosol-forming substrate. Due to the particulate nature of the susceptor heat is produced according to the distribution of the particles in the tobacco sheet.

In some preferred embodiments of the tobacco product according to the invention, the tobacco material is homogenized tobacco material and the aerosol former comprises glycerin. Preferably, the tobacco product is made of a cast leaf as described above.

It has further been found that only specific susceptor particles having specific characteristics are suitable in combination with a tobacco product made of crimped tobacco sheet containing an aerosol former, especially made of a crimped cast leaf and preferably containing glycerin as aerosol-former, in order to provide sufficient heat for optimal aerosol formation but preferably without burning the tobacco or the fibers.

With an optimal selection and distribution of the particles in the tobacco sheet, energy required for heating may be reduced. However, enough energy to release the volatile compounds from the substrate is still provided. Energy reduction may not only reduce energy consumption of an inductive heating device for aerosol generation the tobacco product is used with, but may also reduce the risk of overheating the aerosol-generating substrate. Energy efficiency is also achieved by achieving a depletion of aerosol former in the tobacco product in a very homogeneous and complete manner. Especially, also peripheral regions of a tobacco product may contribute to aerosol formation. By this, a tobacco product such as a tobacco plug may be used more efficiently. For example, a smoking experience may be enhanced or the size of the tobacco product may be reduced by evaporating a same amount of volatile compounds from the tobacco product as in a conventionally more extensively heated or larger aerosol-forming substrate. Thus, cost may be saved and waste may be reduced.

According to an aspect of the tobacco product according to the invention, the susceptor particles have sizes in a range of about 5 micrometer to about 100 micrometer, preferably in a range of about 10 micrometer to about 80 micrometer, for example have sizes between 20 micrometer and 50 micrometer. Sizes in these ranges for particles used as susceptor have been found to be in an optimal range to allow for a homogenous distribution in a tobacco sheet. Too small particles are not desired due to the skin effect not enabling the small particles to efficiently generate heat. In addition, smaller particles may pass through a conventional filter as used in smoking articles. Such filters may also be used in combination with the tobacco product according to the invention. Larger particles render difficult or impossible a homogenous distribution in a sheet material and especially in a tobacco product formed by crimping a tobacco sheet. Larger particles may not be distributed in the tobacco sheet as finely as smaller particles. In addition, larger particles tend to stick out of the tobacco sheet, such that they may contact each other upon crimping of the tobacco sheet. This is unfavorable due to locally enhanced heat generation. The size of particles is herein understood as the equivalent spherical diameter. Since the particles may be of irregular shape, the equivalent spherical diameter defines the diameter of a sphere of equivalent volume as a particle of irregular shape.

According to another aspect of the tobacco product according to the invention, the plurality of particles amounts to a range between about 4 weight percent and about 45 weight percent, preferably to between about 10 weight percent and about 40 weight percent, for example to 30 weight percent of the tobacco product. It will now be obvious to one of ordinary skill in the art that while various weight percent of susceptor are provided above, changes to the composition of the elements comprising the tobacco product, including the weight percent of tobacco, aerosol former, binders, and water will require adjustment of the weight percent of susceptor required to effectively heat the tobacco product.

Amounts of susceptor particles in these weight ranges relative to the weight of the tobacco product have been found to be in an optimal range to provide a homogeneous heat distribution over the entire tobacco product. In addition, these weight ranges of susceptor particles are in an optimal range to provide sufficient heat to heat the tobacco product to a homogeneous and average temperature, for example to temperatures of between 200 degree Celsius and 240 degree Celsius.

According to another aspect of the tobacco product according to the invention, the particles comprise or are made of a sintered material. Sintered material provides a wide variety of electric, magnetic and thermal properties. Sinter material may be of ceramic, metallic or plastic nature. Preferably, for susceptor particles metallic alloys are used. Depending on the manufacturing process such sinter materials may be tailored to a specific application. Preferably, sinter material for the particles used in the tobacco product according the invention has a high thermal conductivity and a high magnetic permeability.

According to a further aspect of the tobacco product according to the invention, the particles comprise an outer surface which is chemically inert. A chemically inert surface prevents the particles to take place in a chemical reaction or possibly serve as catalyst to initialize an undesired chemical reaction when the tobacco product is heated. An inert chemical outer surface may be a chemically inert surface of the susceptor material itself. An inert chemical outer surface may also be a chemically inert cover layer that encapsulates susceptor material within the chemically inert cover. A cover material may withstand temperatures as high as the particles are heated. An encapsulation step may be integrated into a sinter process when the particles are manufactured. Chemically inert is herein understood with respect to chemical substances generated by heating the tobacco product and being present in the tobacco product.

In some preferred embodiments of the tobacco product according to the invention, the particles are made of ferrite. Ferrite is a ferromagnet with a high magnetic permeability and especially suitable as susceptor material. Main component of ferrite is iron. Other metallic components, for example, zinc, nickel, manganese, or non-metallic components, for example silicon, may be present in varying amounts. Ferrite is a relatively inexpensive, commercially available material. Ferrite is available in particle form in the size ranges of the particles used in the tobacco product according to the invention. Preferably, the particles are a fully sintered ferrite powder, such as for example FP350 available by Powder Processing Technology LLC, USA.

According to yet a further aspect of the tobacco product according to the invention, the susceptor has a Curie temperature between about 200 degree Celsius and about 450 degree Celsius, preferably between about 240 degree Celsius and about 400 degree Celsius, for example about 280 degree Celsius.

Particles comprising susceptor material with Curie temperatures in the indicated range allow to achieve a rather homogeneous temperature distribution of the tobacco product and an average temperature of between about 200 degree Celsius and 240 degree Celsius. In addition, local temperatures of the aerosol-forming substrate do generally not or not significantly exceed the Curie temperature of the susceptor. Thus, local temperatures may be below about 400 degree Celsius, below which no significant burning of the aerosol-forming substrate occurs.

When a susceptor material reaches its Curie temperature, the magnetic properties change. At the Curie temperature the susceptor material changes from a ferromagnetic phase to a paramagnetic phase. At this point, heating based on energy loss due to orientation of ferromagnetic domains stops. Further heating is then mainly based on eddy current formation such that a heating process is automatically reduced upon reaching the Curie temperature of the susceptor material. Reducing the risk of overheating the aerosol-forming substrate may be supported by the use of susceptor materials having a Curie temperature, which allows a heating process due to hysteresis loss only up to a certain maximum temperature. Preferably, susceptor material and its Curie temperature are adapted to the composition of the aerosol-forming substrate in order to achieve an optimal temperature and temperature distribution in the tobacco product for an optimum aerosol generation.

According to an aspect of the tobacco product according to the invention, the tobacco product has the form of a rod with a rod diameter in the range between about 3 millimeters to about 9 millimeters, preferably between about 4 millimeters to about 8 millimeters, for example 7 millimeters. The rod may have a rod length in the range between about 2 millimeters to about 20 millimeters, preferably between about 6 millimeters to about 12 millimeters, for example 10 millimeters. Preferably, the rod has a circular or oval cross-section. However, the rod may also have the cross-section of a rectangle or of a polygon.

To facilitate easy handling of the tobacco rod by a consumer, the rod may be provided in a tobacco stick that includes the rod, a filter, and a mouthpiece formed sequentially. The filter may be a material capable of cooling the aerosol formed from the rod material and may also be able to alter the constituents present in the aerosol formed. For example, if the filter is formed of a polylactic acid or of a similar polymer, the filter may remove or reduce phenol levels in the aerosol. The rod, filter, and mouthpiece may be circumscribed with a paper having sufficient stiffness to facilitate the handling of the rod. The length of the tobacco stick may be between 20 mm and 55 mm, and preferably may be approximately 45 mm in length.

Accordingly, in another aspect of the invention, there is provided a tobacco material containing unit, for example a tobacco stick, the unit comprising a tobacco product as described in this application and a filter. The tobacco product and the filter are aligned in an endwise manner and are wrapped with a sheet material, for example paper, for fixing filter and tobacco product in the tobacco material containing unit.

The invention is further described with regard to embodiments, which are illustrated by means of the following drawings, wherein FIG. 1 is a schematic drawing of a tobacco sheet with homogenized tobacco material and susceptor particles;

Figure 1:
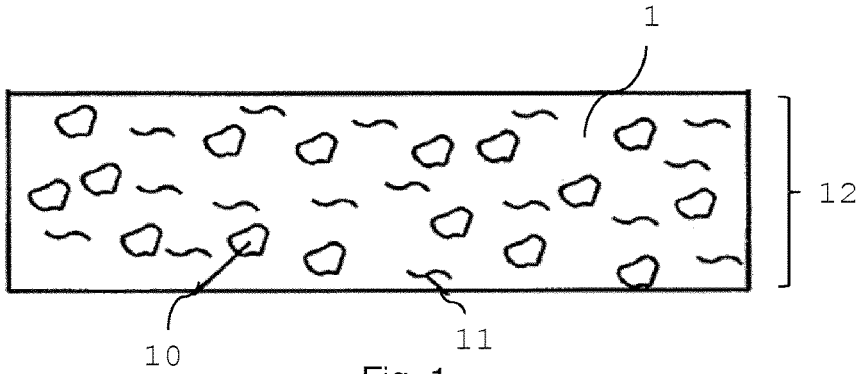

FIG. 1 schematically shows an aerosol-forming substrate in the form of a tobacco sheet 1. The tobacco sheet is made of homogenized tobacco particles 11 and preferably is a cast leaf as defined above and contains susceptor particles 10.

The thickness 12 of the tobacco sheet preferably lies between 0.8 millimeters and 1.5 millimeters, while the size of the susceptor particles preferably lies between 10 micrometers and 80 micrometers. For forming the tobacco product according to the invention, the tobacco sheet 1 is crimped and folded to form a tobacco rod. Such a continuous rod is then cut to the required size for a tobacco plug to be used in combination with an inductive heating device for aerosol generation.

Figure 2:
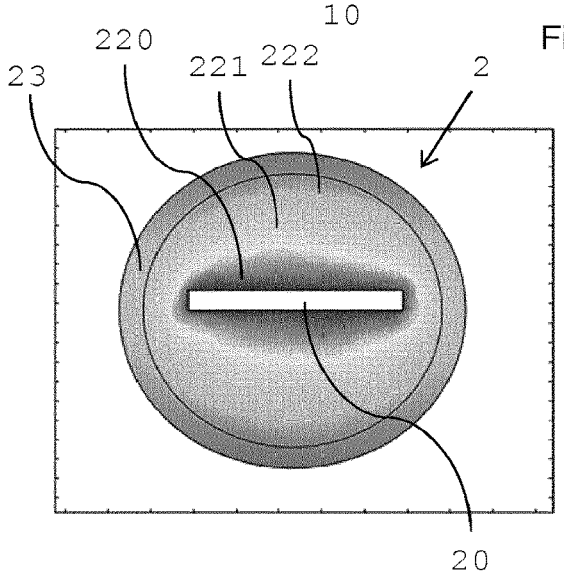
FIG. 2 shows a temperature simulation of a tobacco plug made of a crimped homogenized tobacco sheet heated by a heating blade.

FIG. 2 shows a view onto a simulated temperature distribution of a cross-section of a cylindrical tobacco plug 2 heated by a heating blade 20. The tobacco plug contains an aerosol-forming substrate made of a crimped tobacco sheet containing homogenized tobacco material and glycerin as aerosol former. The crimped tobacco sheet formed to rod shape is wrapped by a wrapper 23, for example paper. In the center of the tobacco plug the rectangular resistively heatable heating blade 20 is inserted for heating the aerosol-forming substrate. In FIG. 2 the temperature distribution has been simulated and is shown for heating the plug such that the core temperature is approximately 370 degrees C. in the center and as low as 80 degrees C. at the perimeter. Temperatures in a proximal region 220 of the blade 20 are as high as about 380 degree Celsius. Temperatures in intermediate 221 and distal, peripheral regions 222 are still as low as about 100-150 degree Celsius. Thus, according to the simulation measurement, intermediate and peripheral regions of the blade heated tobacco plug do not or only to a limited extend take part in aerosol formation—at least if the heating of the blade is limited to not completely burn the tobacco in the proximal region 220.

Figure 4:
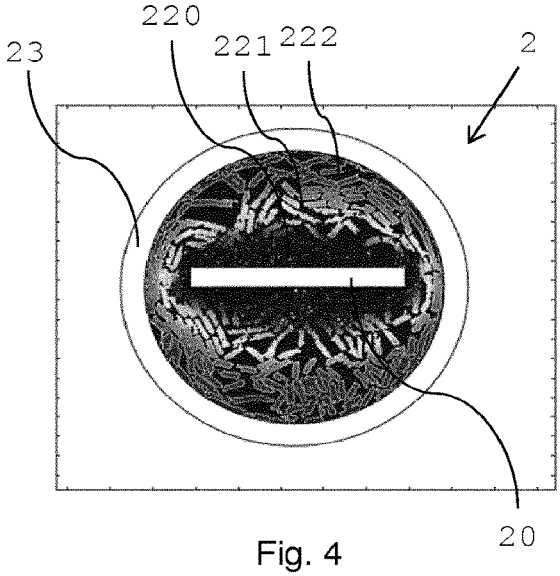
FIG. 4 shows a simulated glycerin depletion profile of the tobacco plug according to FIG. 2.

This is also illustrated in FIG. 4. Therein, glycerin depletion of the tobacco plug according to FIG. 2 is shown. It can be seen that glycerin is entirely depleted in the proximal region 220 after five minutes of heating. No depletion has taken place in the peripheral regions 222, while the intermediate region 221 is partly depleted. Due to the rectangular cross-sectional shape of the heating blade, peripheral regions 222 with no depletion are limited to the parts of the plug, which are arranged next to the long sides of the blade 20. The proximal region 220 is arranged directly adjacent to the heating blade 20 and extends to maximal about ⅓ of the radius to each long side of the blade 20.

Figure 3:
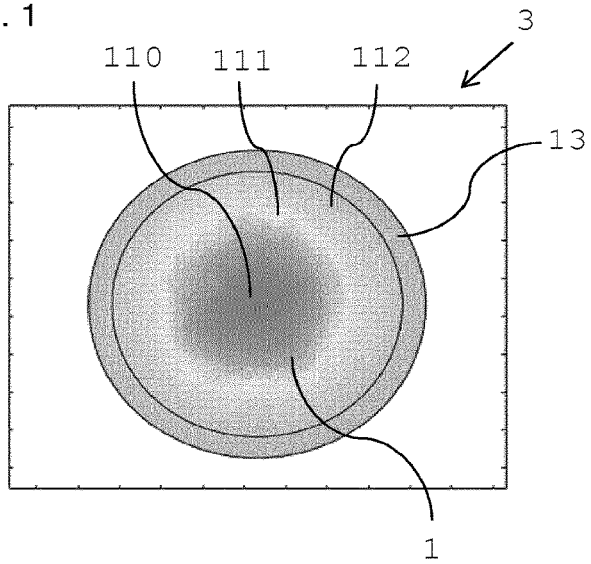
FIG. 3 shows a temperature simulation of a tobacco plug made of a tobacco sheet according to FIG. 1 with uniform susceptor particle distribution.

FIG. 3 shows a view onto a simulated temperature distribution of a cross-section of an inductively heated cylindrical tobacco plug 3. The tobacco plug is made of a crimped tobacco sheet containing susceptor particles as described in FIG. 1. In the tobacco plug used for the temperature simulation 90 milligram FP 350 ferrite particles having an average size of 50 micrometers are evenly distributed in cast leaf made of a slurry of tobacco particles, fibers, binder and glycerin as aerosol former.

The crimped tobacco sheet formed to rod shape is wrapped by a wrapper 13, for example paper. The susceptor particles are homogeneously distributed over the tobacco plug (not shown). The plug is heated via the inductively heated susceptor particles. In FIG. 3 the temperature distribution has been simulated and is shown for heating the plug with a more uniform temperature expected based on the homogeneously distributed susceptor particles within the plug. A temperatures in a central region 110 is about 300 degree Celsius. This circular central region 110 is rather large and extends to about half the radius of the tobacco plug. Temperatures in a narrow annular intermediate region 111 are about 250 degree Celsius and the temperatures of circumferentially arranged peripheral region 112 are about 200 degree Celsius. Thus, according to the simulation measurement, glycerin evaporates rather homogeneously and over the entire or substantially entire area of the tobacco plug. Glycerin is also evaporated from intermediate 111 and peripheral regions 112 of the tobacco plug. Thus, all areas of the tobacco plug are used for aerosol formation, even by maximal heating temperatures well below the ones known from centrally and resistively heated tobacco plugs.

Figure 5:
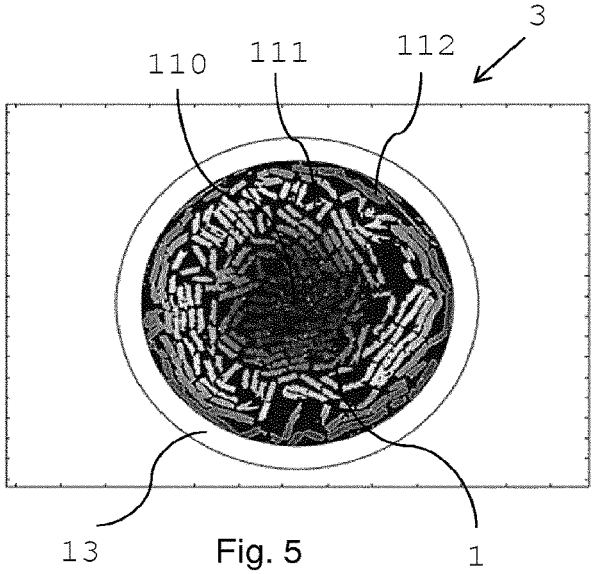
FIG. 5 shows a simulated glycerin depletion profile of the tobacco plug according to FIG. 3.

Glycerin depletion of the tobacco plug of FIG. 3 is illustrated in FIG. 5. It can be seen that glycerin is not yet entirely depleted, not even after five minutes of heating in the central region 110. However, some depletion has already taken place in the intermediate region 111 and to a lesser extent in the peripheral region 112.

Temperature and glycerin depletion simulation of the plugs according to FIGS. 2 and 3 but heated for only about one minute and 1.5 minutes show the same relative temperature behavior. After 1 minute the tobacco plug according to the invention has already achieved a temperature of between about 150 and 200 degree Celsius over the central and intermediate region. Glycerin depletion has not yet commenced. After 1.5 minutes the temperatures have increased in inner peripheral region to about 200 degree Celsius to up to about 280 degrees Celsius in the central region. Temperatures as low as 150 degree Celsius are only present in the outer peripheral region 112. Thus, a glycerin depletion takes place over a large area of the tobacco plug already one to two minutes after starting to heat the tobacco plug.

In contrast to the tobacco plug with susceptor particles according to the invention, a temperature distribution of the tobacco plug according to FIG. 2 with heating blade is almost identical to the one shown in FIG. 2 already after 1.5 minutes of heating. After 1.5 minutes of heating, the proximal region 220 has temperatures already as high as 380 degree Celsius and temperatures as low as about 100 degree Celsius in the intermediate and peripheral regions. After 1 minute of heating only a very small proximal region around the heating blade 20 is heated to about 200 degree Celsius. The remaining regions have slightly elevated temperatures or are still at room temperature.

Figure 6:
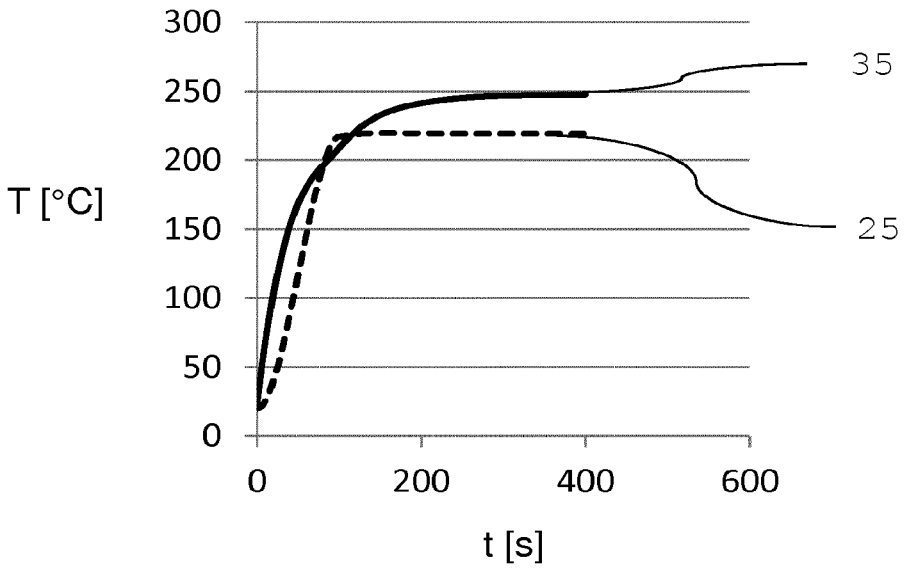
FIG. 6 shows simulated average temperature curves versus time of a tobacco plug heated with a heating blade and comprising uniform susceptor particle distribution, for example according to FIGS. 2 and 3.

In FIG. 6 the average temperature T in the tobacco plug volume of the plug according to FIG. 1 and FIG. 3 versus time t is depicted. Line 35 indicates the temperature curve of the tobacco plug with susceptor particles according to the invention and line 25 indicates the temperature curve of the tobacco plug heated with heating blade. Maximum heating temperature of the heating blade was limited to 360 degree Celsius, while a Curie temperature of the susceptor in the tobacco plug according to the invention was between 350 and 400 degree Celsius. It can be seen that in the plug with the homogeneously distributed particles the average temperature rises much faster and slowly approaches a maximum average temperature of about 250 degree Celsius. The average temperature of the blade heated tobacco plug takes a bit longer to raise. The maximum average temperature in the blade heated plug lies at around 220 degree Celsius. No higher average temperatures may be reached due to the peripheral regions not being heated by the heating blade.

The invention claimed is:

1. An inductively heatable tobacco product for aerosol-generation, the tobacco product comprising:

an aerosol-forming substrate containing a susceptor in the form of a plurality of magnetic particles, wherein the aerosol-forming substrate comprises tobacco material, fibers, binder, aerosol-former comprising glycerin, wherein sizes of the magnetic particles of the plurality of magnetic particles are in a range of about 5 micrometer to about 100 micrometer, wherein the plurality of magnetic particles amounts to a range between about 10 weight percent and about 40 weight percent of the tobacco product, and wherein the susceptor has a Curie temperature between 200 degree Celsius and 400 degree Celsius, the Curie temperature being a temperature at which the susceptor undergoes a phase change from a ferromagnetic phase to a paramagnetic phase.

2. The tobacco product according to claim 1, wherein the sizes of the magnetic particles of the plurality of magnetic particles are in a range of about 10 micrometer to about 80 micrometer.

3. The tobacco product according to claim 1, wherein the sizes of the magnetic particles of the plurality of magnetic particles are in a range of about 20 micrometer to about 50 micrometer.

4. The tobacco product according claim 1, wherein the magnetic particles of the plurality of magnetic particles are homogeneously distributed in the aerosol-forming substrate.

5. The tobacco product according to claim 1, wherein the tobacco product has a heat loss of at least 0.008 Joule per kilogram.

6. The tobacco product according to claim 5, wherein the heat loss is more than 0.05 Joule per kilogram.

7. The tobacco product according to claim 5, wherein the heat loss is more than 0.1 Joule per kilogram.

8. The tobacco product according to claim 1, wherein the plurality of magnetic particles amounts to 30 weight percent of the tobacco product.

9. The tobacco product according to claim 1, wherein the plurality of magnetic particles comprises a sintered material.

10. The tobacco product according to claim 1, wherein the plurality of magnetic particles is made of ferrite.

11. The tobacco product according to claim 1, wherein the tobacco material is homogenized tobacco material.

12. The tobacco product according to claim 11, wherein the tobacco material comprises tobacco particles having sizes in a range between 30 micrometer and 250 micrometer.

13. The tobacco product according to claim 1, having the form of a rod with a rod diameter in the range between 3 millimeters to 9 millimeters, and with a rod length in the range between 2 millimeters to 20 millimeters.

* * * * *